US011026470B2

(12) United States Patent
Reynolds

(10) Patent No.: US 11,026,470 B2
(45) Date of Patent: Jun. 8, 2021

(54) FLIP FLOP ACCESSORY DEVICE AND METHOD

(71) Applicant: Matthew Reynolds, Albuquerque, NM (US)

(72) Inventor: Matthew Reynolds, Albuquerque, NM (US)

( * ) Notice: Subject to any disclaimer, the term of this patent is extended or adjusted under 35 U.S.C. 154(b) by 0 days.

(21) Appl. No.: 16/244,957

(22) Filed: Jan. 10, 2019

(65) Prior Publication Data

US 2019/0328077 A1 Oct. 31, 2019

Related U.S. Application Data

(60) Provisional application No. 62/615,641, filed on Jan. 10, 2018.

(51) Int. Cl.
*A43B 3/12* (2006.01)
*A43B 23/28* (2006.01)

(52) U.S. Cl.
CPC ..... *A43B 3/122* (2013.01); *A43B 23/28* (2013.01)

(58) Field of Classification Search
USPC ..... 24/18, 712, 129 R, 129 A, 129 D
See application file for complete search history.

(56) References Cited

U.S. PATENT DOCUMENTS 1,442,531 A * 1/1923 Mather ..... B65D 63/14 24/18
2,590,648 A 3/1952 Pitz
2,812,123 A * 11/1957 Girton ..... F41C 33/002 224/150
3,768,711 A * 10/1973 Wilkinson ..... A63C 11/025 294/149
4,530,171 A * 7/1985 Zabala ..... A43B 3/126 36/11.5
D374,692 S * 10/1996 Stroud ..... D21/476
5,813,954 A * 9/1998 Wilkinson ..... A63B 21/0004 482/124
6,499,234 B2 * 12/2002 Manzi ..... A43B 3/122 36/100
7,000,809 B1 * 2/2006 Stroud ..... A45F 5/02 224/250
8,020,319 B1 * 9/2011 Mohaupt ..... A43B 3/122 36/101
8,381,415 B1 * 2/2013 Lanoue ..... A43B 3/248 36/11.5
8,539,653 B2 9/2013 Gerhardt
D732,807 S * 6/2015 Collins ..... D2/916
2006/0026861 A1 * 2/2006 Manzi ..... A43B 3/122 36/11.5
2006/0075656 A1 * 4/2006 Januszewski ..... A43B 3/122 36/11.5

(Continued)

*Primary Examiner* — Jocelyn Bravo
(74) *Attorney, Agent, or Firm* — Gina T. Constant, Esq.

(57) ABSTRACT

This flip flop accessory holds a flip flop more securely to the foot when the wearer wants to run, jump, walk backwards, or dangle their feet—activities where flip flops often dislodge. It is comprised of two anchoring points screws on either side of the sole and an elastic cord that attaches to the screws and wraps around the ankle. The wearer screws anchoring screws into the sides of the sole, wraps the cord around the ankle looping the ends around the anchor screws, and then adjusts the length of the cord to maximize comfort and functionality.

5 Claims, 7 Drawing Sheets

(56) References Cited

U.S. PATENT DOCUMENTS

| | | | | |
|---|---|---|---|---|
| 2008/0060230 | A1* | 3/2008 | Kernkamp | A43B 3/16<br>36/70 R |
| 2008/0189984 | A1* | 8/2008 | Januszewski | A43B 3/242<br>36/100 |
| 2013/0160326 | A1* | 6/2013 | Szekeresh | A43B 7/32<br>36/102 |
| 2015/0040434 | A1* | 2/2015 | Perkins | A43B 3/24<br>36/101 |
| 2015/0320141 | A1* | 11/2015 | Collins | A43B 3/128<br>36/100 |
| 2016/0113350 | A1* | 4/2016 | Sashen | A43B 3/122<br>36/11.5 |
| 2017/0164682 | A1* | 6/2017 | Pianta | A43B 3/24 |
| 2017/0172257 | A1* | 6/2017 | Meraz | A43C 11/24 |

* cited by examiner

FLIP FLOP ACCESSORY DEVICE AND METHOD

CROSS-REFERENCE TO RELATED APPLICATIONS

This application claims priority to and the benefit of the filing of U.S. Provisional Patent Application Ser. No. 62/615,641, filed on Jan. 10, 2018, entitled "Flip Flop Accessory Device and Method" and the specification thereof is incorporated here by reference.

BACKGROUND OF THE INVENTION

The field of the present invention is footwear accessories. Specifically, a flip flop accessory that attaches the footwear to the user's foot more securely. Flip flops are a type of backless footwear consisting of a flat sole held loosely on the foot by a Y-shaped strap known as—and referred to herein as—an "upper" that passes between the first and second toes and around both sides of the foot. Unlike other sandals, flip flops do not provide any contact with the back of the foot, the ankle, or the heel area other than the bottom of the heel of the foot. This makes them easy to put on and take off.

Sometimes, the flip flop wearer may want the shoes to fit more snugly and be more secure. For instance, if the user knows they may need to run, jog, jump, or walk backwards, then their flip flops need to be more secure. Or if the wearer is worried they will fall off while their feet are dangling, say in a Ferris wheel car, on a roller coaster, while hang gliding, or sitting on the back of a boat, they would want a more secure fit. The present invention accomplishes this.

BRIEF SUMMARY OF THE INVENTION

The present invention is an accessory to the flip flop that is designed to hold the flip flop more securely to a person's foot by applying a gentle yet firm inward and upward pull. It is comprised of two anchoring points on either side of the flip flop's sole, and a cord or strap, preferably elasticized, with two anchoring screws or nails. The screws can be screwed into the flip flop sole at the location of the anchoring points and the cord attached to the anchoring points by looping the cord's ends around the screws and holding the loop in place using a sliding bead. In the preferred embodiment, the method of installation would be to screw one anchoring screw into to the inside of the sole, screw the other anchoring screw into to the outside of the sole, secure one end of the cord to one anchoring screw, wrap the cord around the ankle one turn starting in the back, and securing the other end of the cord to the other anchoring screw. At least one of the cord's ends may include an additional sliding bead so that the wearer can adjust the length of the cord to maximize comfort and functionality.

When the present invention is installed on a flip flop, it holds the sole of the flip flop so that the sole contacts the entire bottom of the foot, including the heel, while the foot is in the air during mid-stride while walking or if jumping, running, hang-gliding, or riding a roller coaster. This eliminates the need to take shortened strides while walking in everyday flip flops or to scrunch the toes in order to hold the flip flop on the foot.

In the preferred embodiment, the anchoring screws are specially selected coarse threaded screws that attach to the flip flop sole just under the area where the upper is secured on the inside and outside portions of the sole. Also, the strap or cord is elastic and is made of a very soft, fabric-coated elastic band that gently yet firmly hugs the ankle. Additionally, the elastic cord may include a piece of material that lies between the back of the person's ankle and the elastic cord to protect the ankle from discomfort. A simple sliding bead slips on the elastic cord to create a small loop that hooks to the anchoring screw. The anchoring screw may also have a barbed fishhook like threading to prevent the screw from backing out of the sole of the flip flop.

Also in the preferred embodiment, the elastic cord can be adjusted to fit all flip flops and ankle sizes. The strap or cord can be made of a flat elastic band or a round cord type of elastic band. The elasticity of the cord should be carefully determined so as to balance the wearer's comfort with the functionality of the accessory. Each band can also be customized and embellished with any type of decorative charm or bead, which can also function as the sliding beads. Simple catch phrases such as "Beach Bum" can also be added to any strap to appeal to different markets. Flat elastic bands and straps could also be printed with company logos for promotional reasons.

Further, the anchoring point on the inside of the flip flop should be approximately directly below the inside arch of the person's foot. The anchoring screws should be screwed into the sole at a 90 degree angle so that the anchor screw is approximately horizontal to the ground and should protrude from the sole approximately ⅛ inch. This facilitates the looped knotted ends of the elastic cord being wrapped around, and anchored to, the anchoring screws. Also in the preferred embodiment, the other anchoring screw on the outside of the sole should be located approximately directly across from anchoring screw on the inside of the sole. Additionally, there should be about ¼ inch of extra elastic cord after the knot to prevent the knotted end from unravelling. The adjustable knotted end of the elastic cord (marked by two sliding beads instead of one) should be anchored to the anchoring screw on the outside of the sole so that the elastic cord can be easily adjusted.

The flip flop accessory may also be modified for use with flip flops or sandals that are pre-fabricated to include anchoring points or anchoring points with screws or nail type devices already attached to the flip flop's sole.

The preferred embodiment of the method of using the flip flop accessory of the present invention is a follows: Obtaining a flip flop, said flip flop comprised of at least an upper and a sole, said sole having top, bottom, inside and outside portions; Locating a first anchoring point on either the inside or outside of the sole of the flip flop; Screwing a first anchoring screw comprised of a screw head and a screw shank, into the first anchoring point allowing the screw shank to partially protrude from the inside of the sole; Screwing a second anchoring screw into a second anchoring point located on the other side of the sole allowing the screw shank to partially protrude from the inside of the sole; Obtaining an elastic cord, said cord comprising two knotted ends, each formed into a loop that is secured with a first sliding bead; Putting the flip flop on a person's foot; Inserting the first anchoring screw into the loop of the first knotted end of the elastic cord and sliding the first sliding bead toward the first anchoring screw to secure the elastic cord around the anchoring screw; Wrapping the elastic cord around the person's ankle beginning from the back of the ankle, around the front of the ankle, and returning to the back of the ankle; Inserting the second anchoring screw into the loop of the second knotted end of the elastic cord; And sliding the sliding beads on the knotted ends so that the elastic cord fits comfortably around the person's ankle and secures the flip flop to the person's foot. Sliding beads can be used to adjust the cord length so that the flip flop accessory secures the flip flop to the person's foot while fitting comfortably around the ankle. The same process may then be repeated for the flip flop on the person's other foot.

To remove the flip flop accessory, the wearer simply slips their heel out while pulling down on the cord or they can unhook either side of the looped knotted ends from around at least one anchoring screw.

As used herein, certain terms have the following definitions:

FLIP FLOPS are a type of backless footwear consisting of a sole held on the foot by a Y-shaped strap known as an "upper" that passes between the first and second toes and around both sides of the foot.

ELASTICITY is the ability of an object or material, such as a cord, to resume its normal shape after being stretched or compressed.

A SLIDING BEAD is a bead of any shape or size with a hole roughly the width of the looped elastic cord and smaller than the knots at the ends of the cord. The sliding bead may be made from any material that holds a shape including glass, metal, leather, wood, bone, stone, resin, clay, quartz, and the like.

DETAILED DESCRIPTION OF THE DRAWINGS

Figure 1:
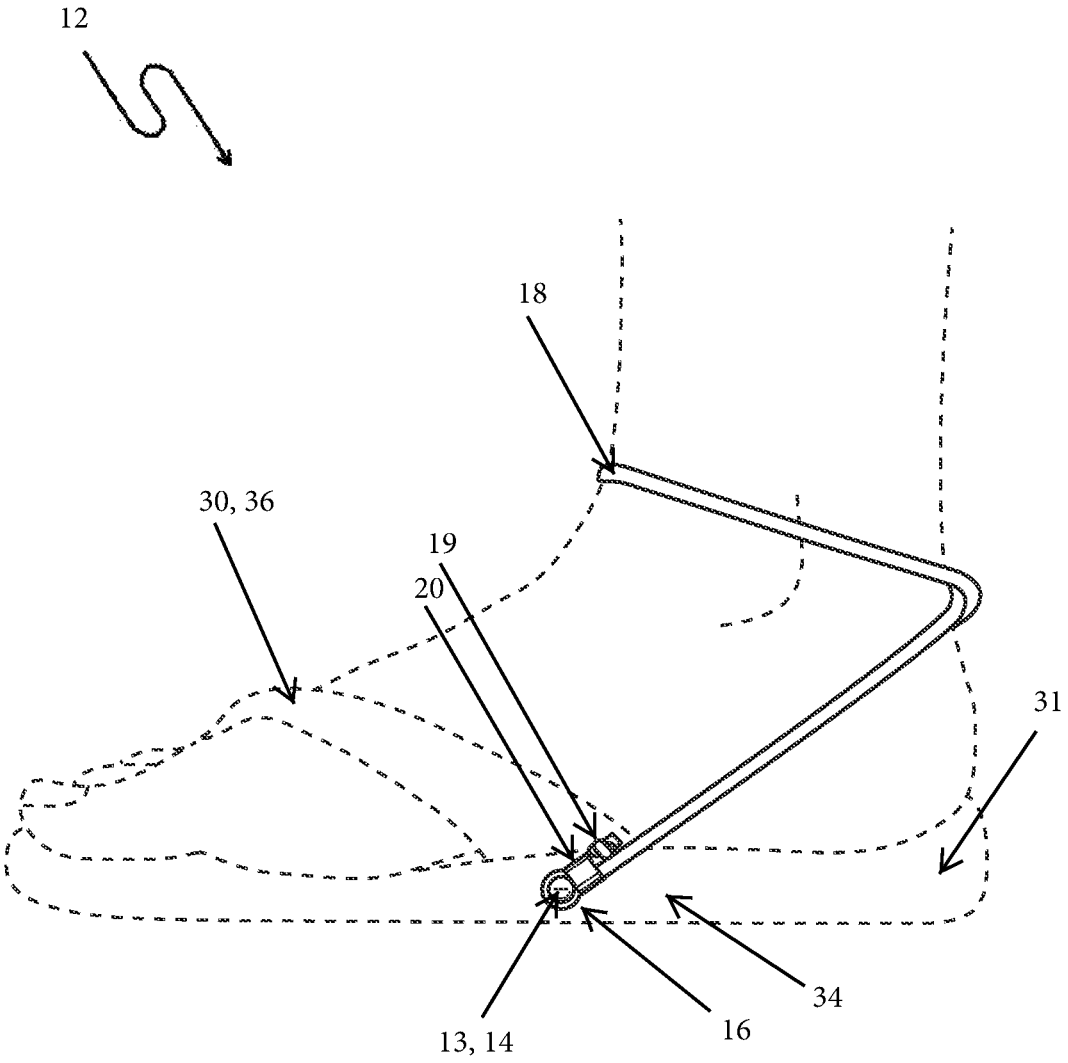
FIG. 1 is a side view of the present invention showing the inside view of the flip flop accessory.
Figure 6:
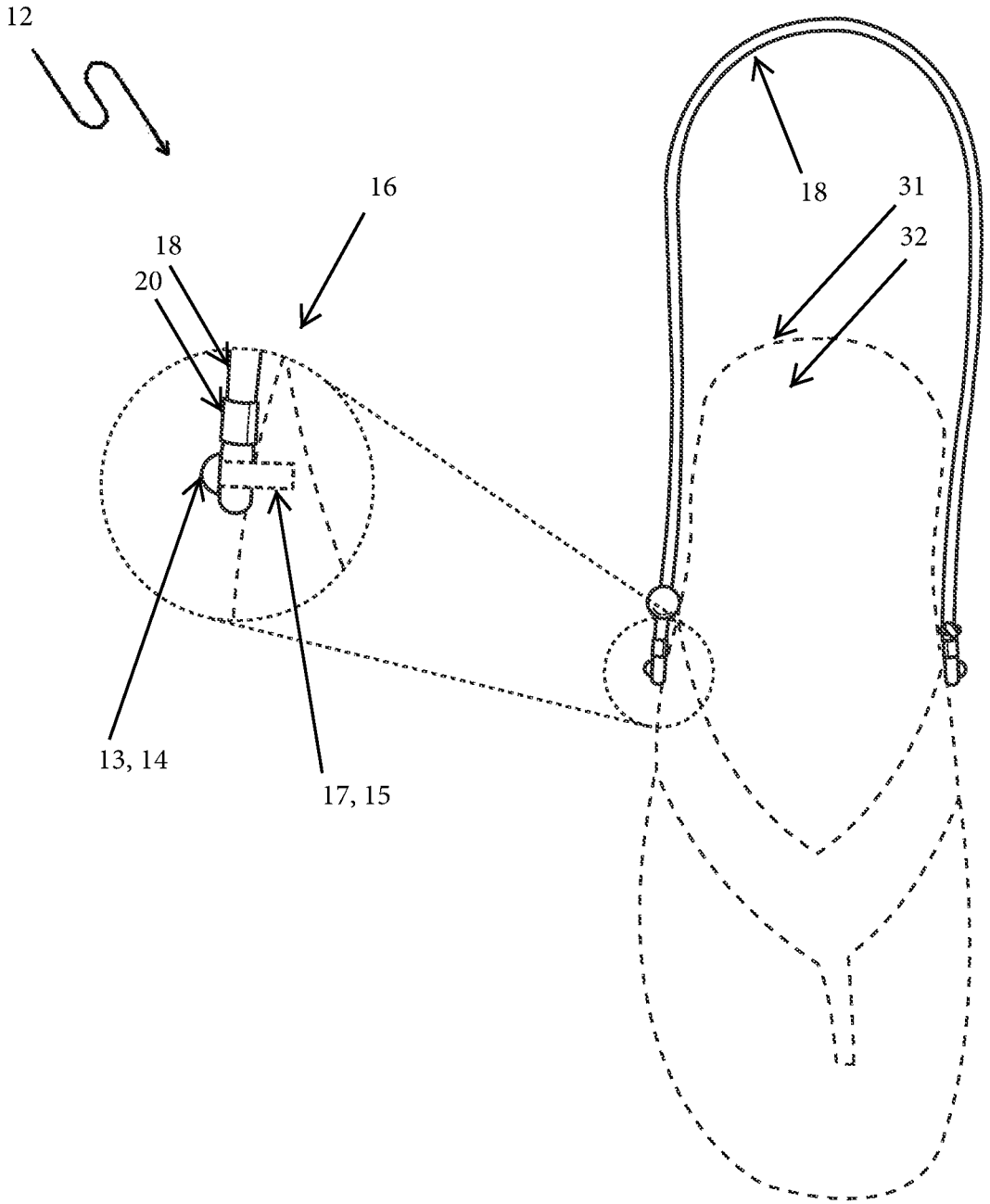
FIG. 6 is a top view of the flip flop accessory including a detailed view of one anchoring point.

FIG. 1 is a side view of the present invention showing the inside view of the flip flop accessory 12 comprised of an anchoring screw 13 with a screw head 14 and a screw shaft 15 (not shown, see FIG. 6); An anchoring point 16 located in the flip flop's sole 31, said sole 31 having top, bottom, inside 34, and outside 35 (not shown, see FIG. 2) portions; A cord 18 sized to extend from the first anchoring point 16, wrapping around a person's ankle, to the second anchoring point 16 (not shown, see FIG. 2). If said cord 18 is an elastic cord then is should have sufficient elasticity to comfortably wrap around the person's ankle while securing the flip flop's sole 31 to the person's foot; And the cord 18 has a knotted end 19 formed into a loop that is secured with a first sliding bead 20.

Figure 2:
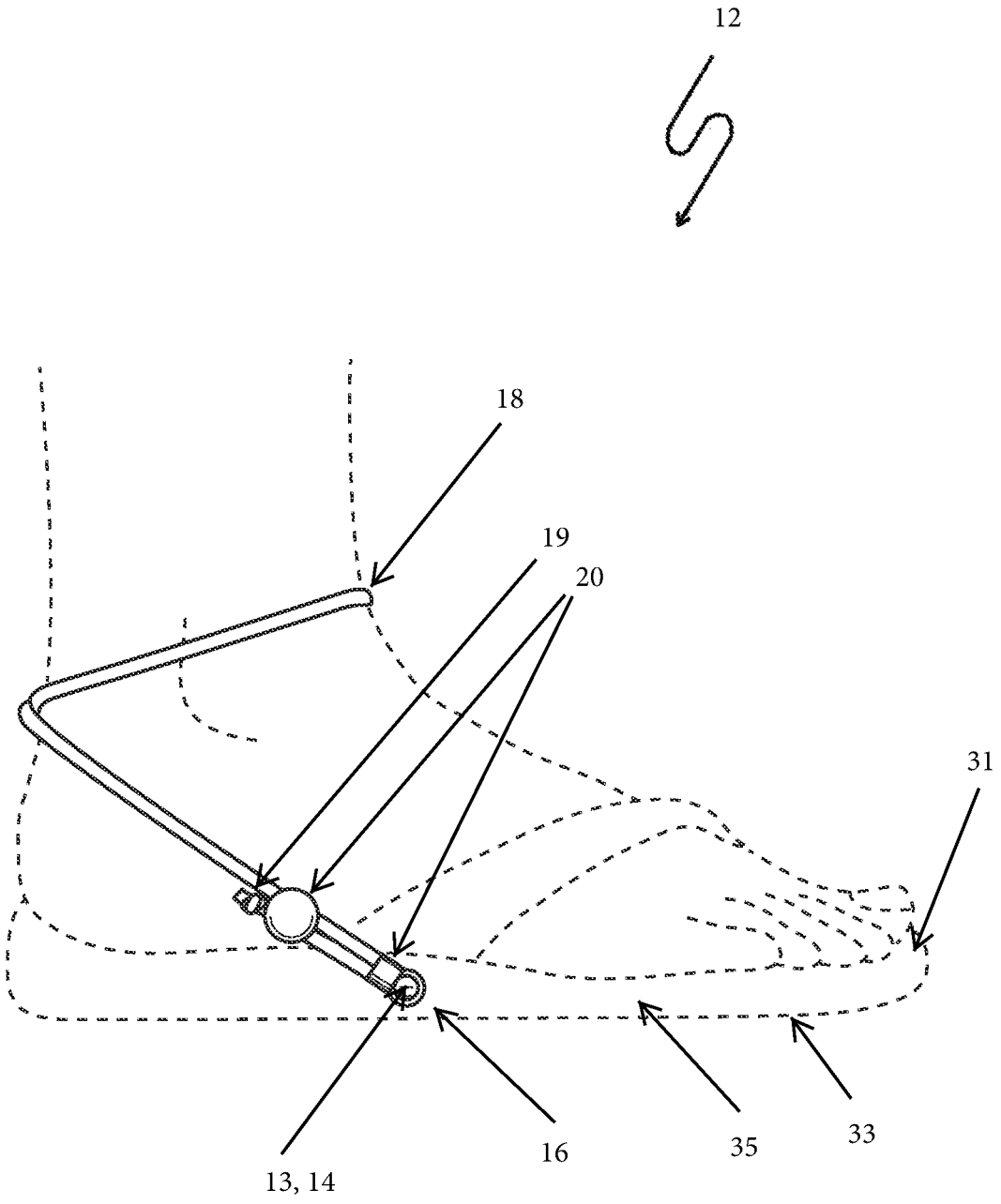
FIG. 2 is a side view of the present invention showing the outside view of the flip flop accessory.

FIG. 2 is a side view of the present invention showing the outside view of the flip flop accessory 12 comprised of an anchoring screw 13 with a screw head 14 and a screw shaft 15 (not shown, see FIG. 6); An anchoring point 16 located in the flip flop's sole 31, said sole 31 having an inside 34 (not shown, see FIG. 1) and outside 35 portion; An elastic cord 18 sized to extend from the first anchoring point 16 (not shown, see FIG. 1), wrapping around a person's ankle, to the second anchoring point 16, said elastic cord 18 having sufficient elasticity to comfortably wrap around the person's ankle while securing the flip flop's sole 31 to the person's foot; The elastic cord 18 has a knotted end 19 formed into a loop that is secured with a first sliding bead 20; And at least one knotted end 19 having a second sliding bead 20 located between the knotted end 20 and the first sliding bead 20, thereby making the length of the elastic cord 18 adjustable by moving the second sliding bead 20.

Figure 3:
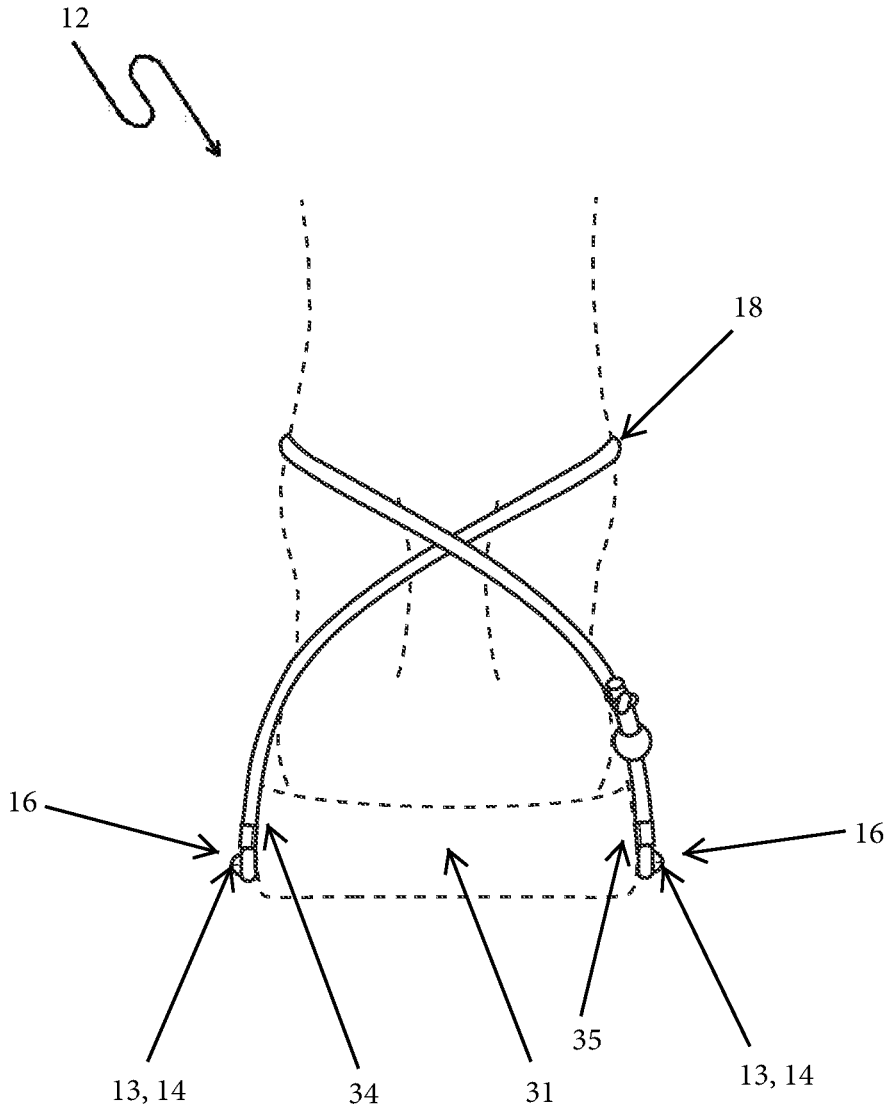
FIG. 3 is a rear view of the flip flop accessory.

FIG. 3 is a rear view of the present invention showing the flip flop accessory 12 comprised of two anchoring screws 13, each comprised of a screw head 14 and a screw shaft 15 (not shown, see FIG. 6); Two anchoring points 16 being located on the inside of the sole 34 and the second anchoring point 16 being located on the outside of the sole 35; And an elastic cord 18 sized to extend from the first anchoring point 16, wrapping around a person's ankle, to the second anchoring point 16, said elastic cord 18 having sufficient elasticity to comfortably wrap around the person's ankle while securing the flip flop's sole 31 to the person's foot.

Figure 4:
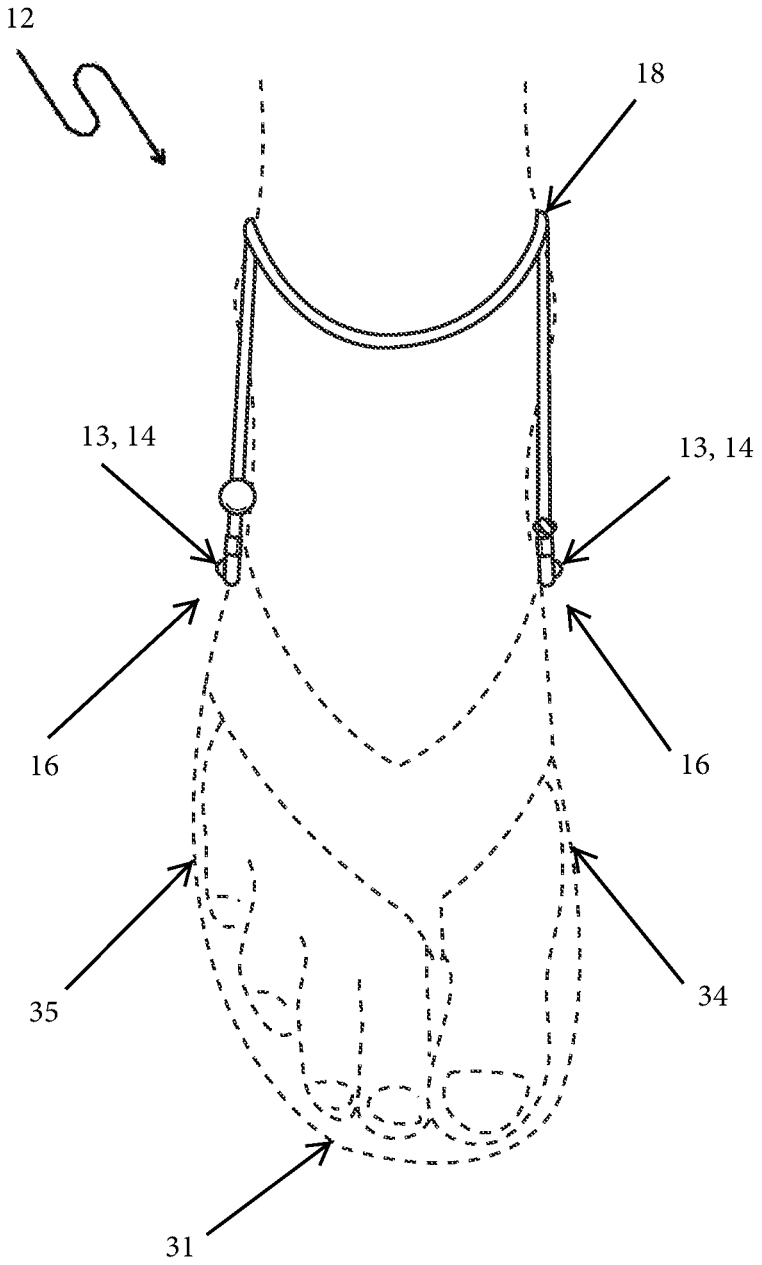
FIG. 4 is a top view of the flip flop accessory.

FIG. 4 is a top view of the present invention showing the flip flop accessory 12 comprised of two anchoring screws 13, each comprised of a screw head 14 and a screw shaft 15 (not shown, see FIG. 6); Two anchoring points 16 located in a flip flop's sole 31; The first anchoring point 16 being located on the inside of the sole 34 and the second anchoring point 16 being located on the outside of the sole 35; And an elastic cord 18 sized to extend from the first anchoring point 16, wrapping around a person's ankle, to the second anchoring point 16, said elastic cord 18 having sufficient elasticity to comfortably wrap around the person's ankle while securing the flip flop's sole 31 to the person's foot.

Figure 5:
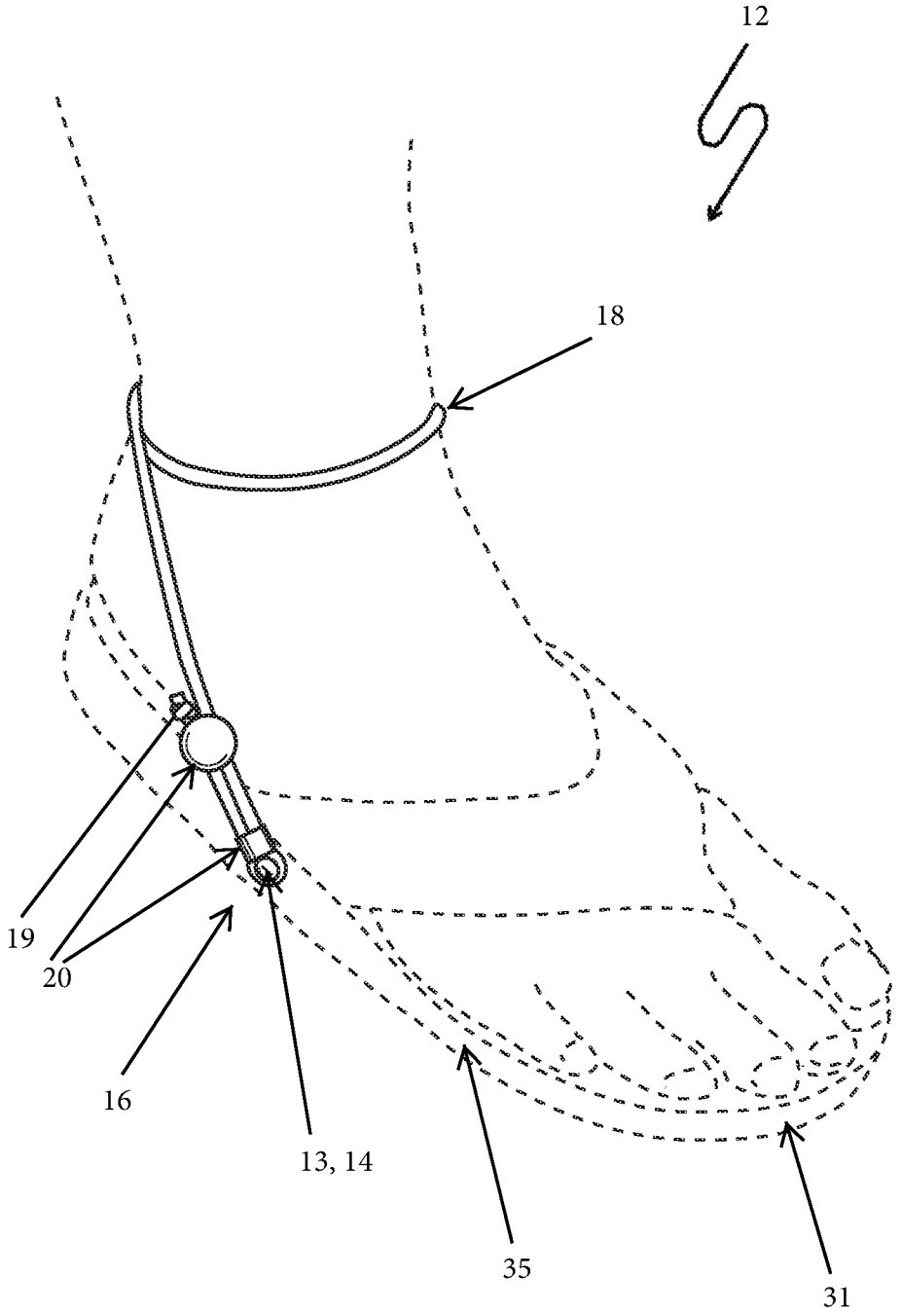
FIG. 5 is a perspective view of the present invention showing the outside and top of the flip flop accessory.

FIG. 5 is a perspective view of the present invention showing the outside and top view of the flip flop accessory 12 comprised of an anchoring screw 13 with a screw head 14 and a screw shaft 15 (not shown, see FIG. 6); An anchoring point 16 located in the flip flop's sole 31, said sole 31 having an inside 34 (not shown, see FIG. 1) and outside 35 portion; An elastic cord 18 sized to extend from the first anchoring point 16 (not shown, see FIG. 1), wrapping around a person's ankle, to the second anchoring point 16, said elastic cord 18 having sufficient elasticity to comfortably wrap around the person's ankle while securing the flip flop's sole 31 to the person's foot; The elastic cord 18 has a knotted end 19 formed into a loop that is secured with a first sliding bead 20; And at least one knotted end 19 having a second sliding bead 20 located between the knotted end 20 and the first sliding bead 20, thereby making the length of the elastic cord 18 adjustable by moving the second sliding bead 20.

FIG. 6 is a top view of the flip flop accessory 12 (see detailed description of FIG. 4) including a detailed view of one anchoring point 16; The flip flop accessory 12 being comprised of two anchoring screws 13, each comprised of a screw head 14 and a screw shaft 15; Two anchoring points 16 located in a flip flop's sole 31, said anchoring points 16 being comprised of a hole 17 into which the anchoring screw 13 can be detachably fastened to the sole 31; An elastic cord 18 extending from the first anchoring point 16 to the second anchoring point 16; And the elastic cord 18 having two knotted ends 19 each formed into a loop that is secured with a first sliding bead 20.

Figure 7:
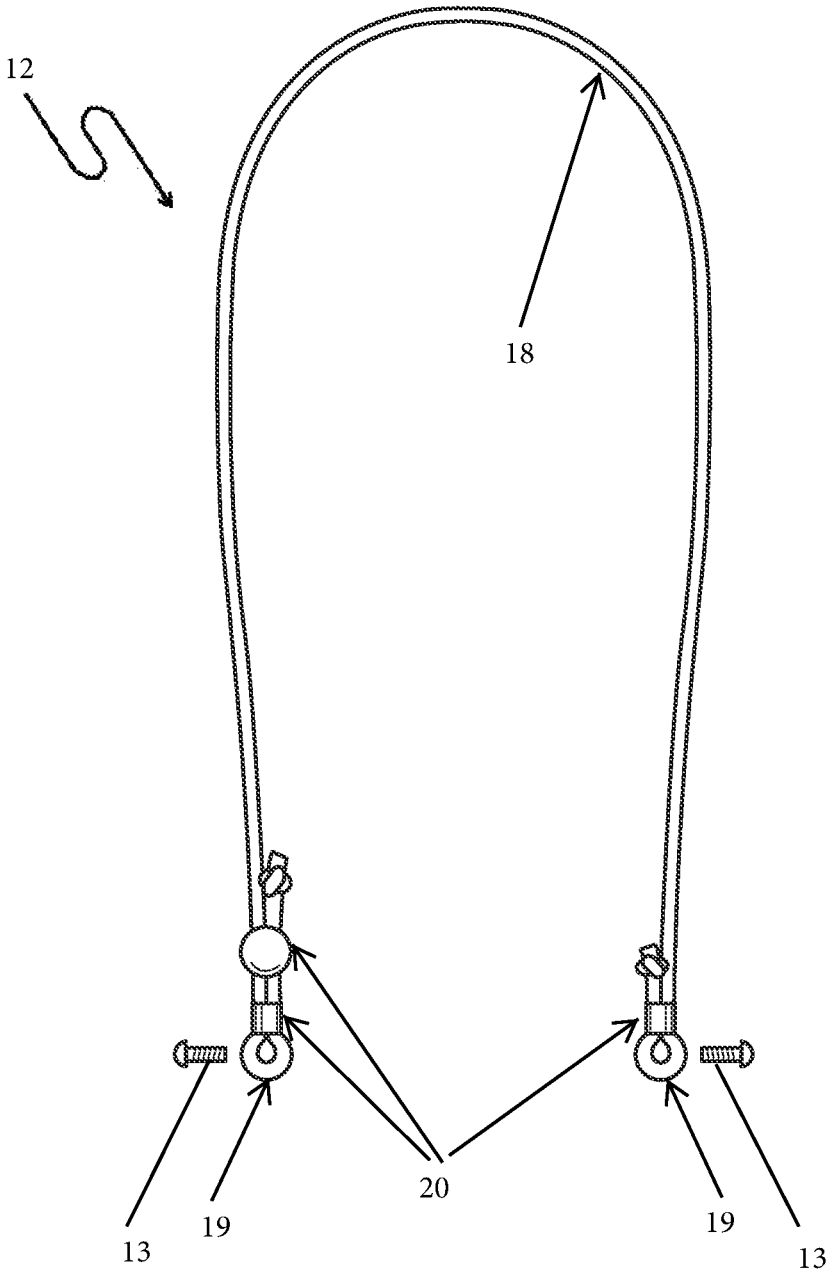
FIG. 7 shows the flip flop accessory by itself and unattached to a flip flop.

FIG. 7 depicts the flip flop accessory 12 comprising two anchoring screws 13, an elastic cord 18 having two knotted ends 19, each formed into a loop that is secured with a first sliding bead 20; And at least one knotted end 19 having a second sliding bead 20 located between the knotted end 20 and the first sliding bead 20, thereby making the length of the elastic cord 18 adjustable by moving the second sliding bead 20.

A method of using the flip flop accessory 12 can be understood by viewing FIGS. 1, 2, 3 and 6. The method comprises the steps of obtaining a flip flop 30, said flip flop 30 comprised of at least an upper 36 and a sole 31, said sole 31 having top 32, bottom 33, inside 34 and outside 35 portions; Locating a first anchoring point 16 on either the inside 34 or outside 35 of the sole of the flip flop 31; Screwing a first anchoring screw 13, comprised of a screw head 14 and a screw shank 15, into the first anchoring point 16 allowing the screw shank 15 to partially protrude from the inside of the sole 34; Screwing a second anchoring screw 13 into a second anchoring point 16 located on the other side of the sole allowing the screw shank 15 to partially protrude from the inside of the sole 34; Obtaining an elastic cord 18, said cord comprising two knotted ends 19, each formed into a loop that is secured with a first sliding bead 20; Putting the flip flop 30 on a person's foot; Inserting the first anchoring screw 13 into the loop of the first knotted end 19 of the elastic cord 18 and sliding the first sliding bead 20 toward the first anchoring screw 13 to secure the elastic cord 18 around the anchoring screw 13; Wrapping the elastic cord 18 around the person's ankle beginning from the back of the ankle, around the front of the ankle, and returning to the back of the ankle; Inserting the second anchoring screw 13 into the loop of the second knotted end 19 of the elastic cord 18; And sliding the sliding beads 20 on the knotted ends so that the elastic cord 18 fits comfortably around the person's ankle and secures the flip flop 30 to the person's foot.

Whereas the figures and description have illustrated and described the concept and preferred embodiment of the present invention, it should be apparent to those skilled in the art that various changes may be made in the form of the invention without affecting the scope thereof. The detailed description above is not intended in any way to limit the broad features or principles of the invention, or the scope of patent monopoly to be granted.

I claim:

1. A flip flop accessory comprising:

a) two anchoring screws, each comprised of a screw head and a screw shaft;

b) a flip flop sole, and two anchoring points located in the flip flop sole, said sole having top, bottom, inside, and outside portions, said anchoring points each comprising a hole into which a respective anchoring screw can be detachably fastened to the sole;

c) the first anchoring point being located on the inside portion of the sole and the second anchoring point being located on the outside portion of the sole;

d) a cord configured to extend from the first anchoring screw, wrap around a person's ankle and foot, and extend to the second anchoring screw;

e) the cord having two knotted ends, each knotted end formed into a respective loop that is secured with a respective first sliding bead; and f) the anchoring screws being inserted through the respective loops of the cord, and the first sliding beads securing the respective loops around the screws.

2. The flip flop accessory of claim 1 wherein at least one knotted end of the two knotted ends has a second sliding bead located between the at least one knotted end and the respective first sliding bead, thereby making the length of the cord adjustable by moving the second sliding bead.

3. A flip flop accessory comprising:

a) a flip flop that is pre-fabricated with two anchoring points and two anchoring screws, each anchoring screw comprised of a screw head and a screw shaft, the flip flop further comprising a flip flop sole, said sole having top, bottom, inside, and outside portions, said anchoring points each comprising a hole into which a respective anchoring screw can be detachably fastened to the sole, the first anchoring point being located on the inside portion of the sole and the second anchoring point being located on the outside portion of the sole;

b) a cord configured to extend from a first anchoring screw of the two anchoring screws, wrap around a person's ankle and foot, and extend to a second anchoring screw of the two anchoring screws;

c) the cord having two knotted ends, each knotted end formed into a respective loop that is secured with a respective first sliding bead; and d) the anchoring screws being inserted through the respective loops, and the first sliding beads securing the respective loops around the screws.

4. The flip flop accessory of claim 3 wherein at least one knotted end of the two knotted ends has a second sliding bead located between the at least one knotted end and the respective first sliding bead, thereby making the length of the cord adjustable by moving the second sliding bead.

5. A method of using a flip flop accessory, the method comprising the steps of:

a) obtaining a flip flop, said flip flop comprised of at least an upper and a sole, said sole having top, bottom, inside and outside portions;

b) locating a first anchoring point on the inside portion of the sole of the flip flop;

c) screwing a first anchoring screw, comprised of a screw head and a screw shank, into the first anchoring point, allowing the screw shank to partially protrude from the inside portion of the sole;

d) screwing a second anchoring screw into a second anchoring point located on the outside portion of the sole, allowing the screw shank to partially protrude from the inside outside portion of the sole;

e) obtaining an elastic cord, said cord comprising a first knotted end and a second knotted end, each formed into a respective loop that is secured with a respective first sliding bead;

f) putting the flip flop on a person's foot;

g) inserting the first anchoring screw into the loop of the first knotted end of the elastic cord and sliding the respective first sliding bead toward the first anchoring screw to secure the elastic cord around the anchoring screw;

h) wrapping the elastic cord around an ankle of the person, beginning from a back of the ankle, around a front of the ankle, and returning to the back of the ankle;

i) inserting the second anchoring screw into the loop of the second knotted end of the elastic cord; and j) sliding the first sliding beads on the knotted ends so that the elastic cord fits comfortably around the person's ankle and secures the flip flop to the person's foot.

* * * * *